United States Patent [19]

Vago

[11] Patent Number: 4,838,211

[45] Date of Patent: Jun. 13, 1989

[54] WATER HEATER CONSTRUCTION AND METHOD OF HEATING WATER

[75] Inventor: Otto Z. Vago, Burns, Tenn.

[73] Assignee: State Industries, Inc., Ashland City, Tenn.

[21] Appl. No.: 188,168

[22] Filed: Apr. 28, 1988

Related U.S. Application Data

[63] Continuation of Ser. No. 498,019, May 25, 1983, abandoned.

[51] Int. Cl.[4] ..... F22B 7/00

[52] U.S. Cl. ..... 122/159; 122/17; 122/382; 122/390; 122/405; 122/383; 126/361; 137/15

[58] Field of Search ..... 126/362, 364, 365, 366, 126/389, 390, 391, 392, 361; 122/13 R, 17, 154, 362, 380, 381, 382, 383, 384, 389, 390, 392, 405, 407, 411; 137/590, 15; 366/138, 167, 173, 178, 179

[56] References Cited

U.S. PATENT DOCUMENTS

| | | | |
|---|---|---|---|
| 216,911 | 6/1879 | Titcomb | 122/405 |
| 218,392 | 8/1879 | Miller | 122/382 |
| 218,542 | 8/1879 | Kremer | 122/411 |
| 277,012 | 5/1883 | Dinkel | 122/390 |
| 325,476 | 9/1885 | Baker | 122/382 |
| 609,845 | 8/1898 | Stephenson | 122/405 |
| 801,447 | 10/1905 | Fellner | 122/405 |
| 1,525,341 | 2/1925 | Uebelmesser | 122/382 |
| 1,585,632 | 5/1926 | Isaacs | 122/382 |
| 1,978,015 | 10/1934 | Erdman | 137/590 |
| 2,290,368 | 7/1942 | Dutton | 122/405 |
| 4,257,355 | 3/1981 | Cook | 122/390 |
| 4,263,879 | 4/1981 | Lindahl | 122/159 |
| 4,505,231 | 3/1985 | Syler | 122/159 |

FOREIGN PATENT DOCUMENTS

| | | | |
|---|---|---|---|
| 1599657 | 10/1981 | United Kingdom | 126/391 |

*Primary Examiner*—James C. Yeung
*Assistant Examiner*—Noah Kamen
*Attorney, Agent, or Firm*—Fuller, Puerner & Hohenfeldt

[57] ABSTRACT

A water heater including a tank having a hot water outlet in the top portion thereof and a cold water inlet in the lower portion thereof. An agitator assembly connected to the cold water inlet and mounted in the bottom portion of the tank. The agitator assembly includes a circular tubular member having a first row of orifice members mounted along the inner side thereof, a second row of orifice members mounted along the outer side thereof and a third row of orifice members mounted along the top side thereof. The orifice members are all directed in the same direction with respect to the axis of the circular tubular member to produce a swirling action in the bottom portion of the tank each time hot water is drawn out of the hot water outlet, such swirling action being effective to cause solid materials which have either settled to the bottom or are in the process of settling to the bottom to be maintained in suspension in the water so that ultimately at least a portion of such materials will be carried upwardly in the tank and out the hot water outlet.

25 Claims, 2 Drawing Sheets

WATER HEATER CONSTRUCTION AND METHOD OF HEATING WATER

This is a continuation of application Ser. No. 498,019 filed on May 25, 1983, now abandoned.

BACKGROUND OF THE INVENTION

I. Field of the Invention

This invention relates to water heaters and a method of heating water and more particularly to a water heater equipped with an agitator means of unique design which is effective to prevent accumulation of scale and other solid particles in the bottom portion of the water heater.

II. Description of the Prior Art

A longstanding problem in the water heater industry is the tendency of dissolved solid particles to precipitate out of the water being heated, which particles will accumulate on the bottom of the tank causing adverse operation and tank failure. Prior constructions directed ti this problem are disclosed in U.S. Pat. Nos. 4,157,077, 4,263,879 and 4,257,355. Each of said prior art constructions are designed to create a stirring action in the bottom portion of the tank to reduce the tendency of particles to accumulate therein. The principle object of the present invention is to provide a water heater construction which is more effective in reducing adverse accumulations of scale than are the prior art constructions referred to above.

SUMMARY OF THE INVENTION

A water heater including a water-tight tank and a source of heating water inside the tank. A hot water outlet is located in the top portion of the tank and an agitator assembly is mounted in the bottom portion of the tank. The agitator assembly includes a circular tubular member connected to a source of water under pressure. The circular tubular member has a first row of orifice members mounted around the inner side thereof and a second row of orifice members mounted around the outer side thereof. The orifice members are directed at an angle with respect to a radius line through each of the orifice members. Each of the orifice members includes a flow passageway through which jet-like streams of water are directed into the tank each time water is drawn out of the hot water outlet. The orifice members are all directed in the same direction with respect to the axis of the circular tubular member to produce a swirling action in the bottom portion of the tank, such swirling action being effective to prevent accumulation of solid materials in the bottom portion thereof.

DESCRIPTION OF THE PREFERRED EMBODIMENT

Figure 1:
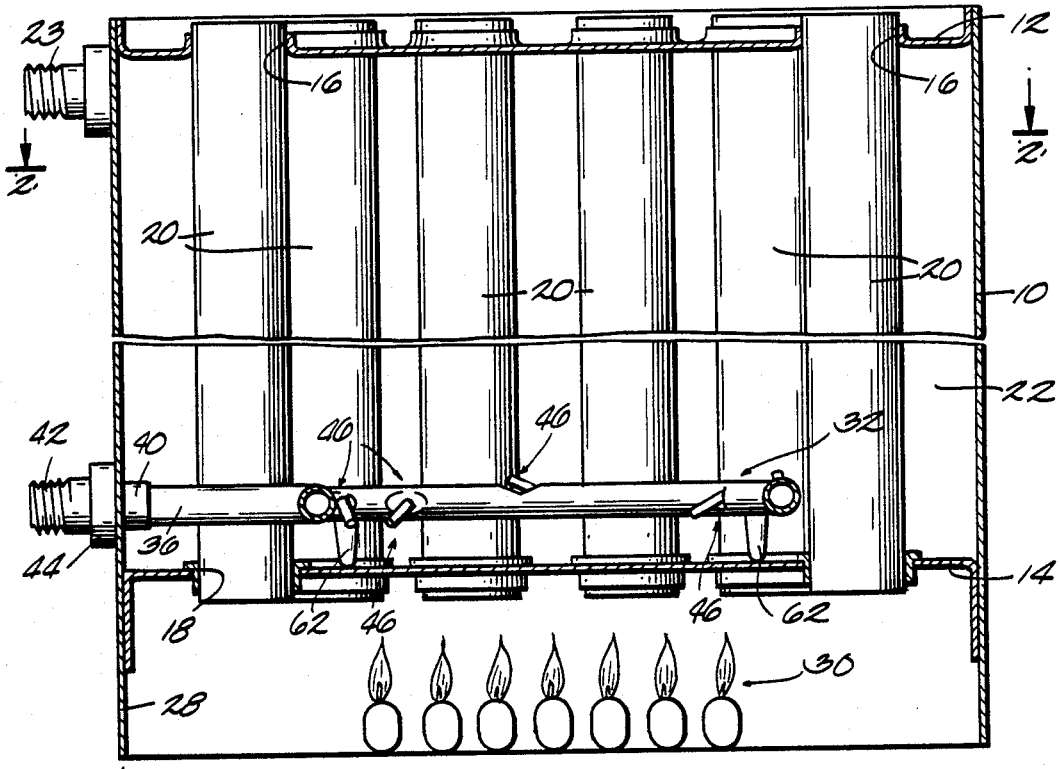
FIG. 1 is a side elevation view (with parts broken away) of a water heater which incorporates the subject matter of the present invention.

Referring to the drawings in detail, the water heater of the present invention is comprised of a tank wall 10, a tank top member 12 and a tank bottom member 14. Top and bottom members 12 and 14 are provided with a plurality of aligned openings 16 and 18, respectively, in which flue tubes 20 are mounted (FIG. 1 does not show a complete set of flue tubes 20). Tank top and bottom members 12 and 14 are sealed to the tank wall 10 and to the flue tubes 20 by any suitable means such as welding to form a liquid tight tank having a water heating chamber 22 therein. A hot water outlet fitting 23 is provided in the top portion of the tank wall 10.

Figure 2:
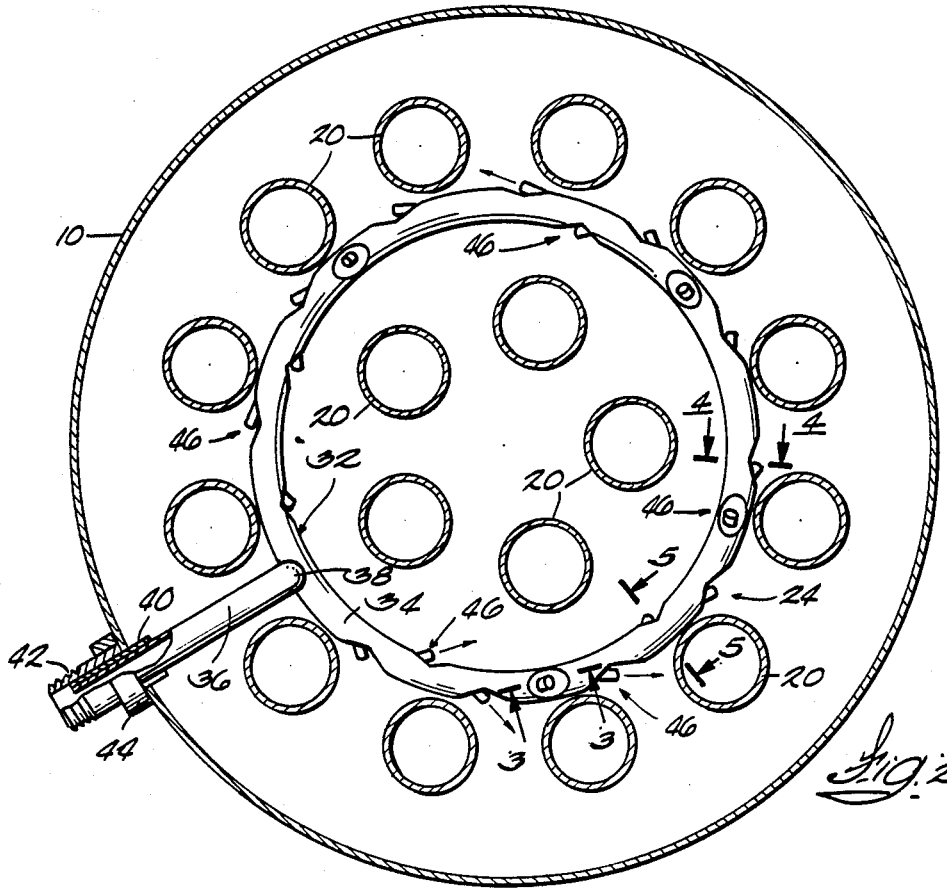
FIG. 2 is a sectional view taken along line 2—2 of FIG. 1.

The flue tube pattern shown in FIG. 2 is typical. The flue tubes 20 are positioned in an outer row designated by numberal 24 and an inner row designated by reference number 26.

The water heater tank is mounted on a support base 28 which houses a burner 30 of conventional construction. Burner 30 is shown schematically in FIG. 1.

Mounted in the lower portion of tank chamber 22 is an agitator assembly indicated generally by reference numeral 32. Agitator assembly 32 is comprised of a circular tubular member 34 and a straight inlet tubular member 36 connected to the circular member 34 at point 38 by any suitable means such as welding. In the preferred embodiment, members 34 and 36 are made of heat and corrosion resistant material such as stainless steel.

Inlet tube 36 extends through the tank wall 10 and fits inside a sleeve 40 which, in turn, is sealed inside a nipple 42. Sleeve 40 is made of an electrically nonconductive material such as plastic. Nipple 42 is threaded into a spud 44 which is welded to the tank wall 10. Nipple 42 is connected to a source of water under pressure by any suitable means (not shown).

It should be noted at this point that circular tubular member 34 of the agitator assembly 32 is located between the outer row 24 and the inner row 26 of flue tubes 20. More specifically, member 34 is located internally of and closely adjacent the outer row 24 of flue tubes 20. The significance of this location will be explained in detail hereinafter.

Circular tubular member 34 is provided with three (3) rows of orifice assemblies 46; i.e., one row on the inner side of the member, a second row on the outer side of the member and a third row on the top of the member.

Figure 3:
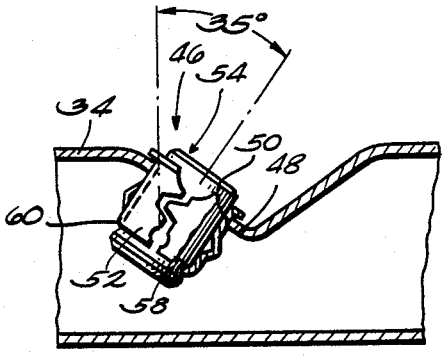
FIG. 3 is a sectional view taken along line 3—3 of FIG. 2.

Orifice assemblies 46 are of identical construction and are mounted on member 34 in an identical manner. In the preferred embodiment, orifice assemblies 46 are mounted on member 34 by the following procedure. Referring to FIG. 3, the first step is to form an indentation in the wall of member 34 to provide a substantially flat angled wall portion 48. This can be accomplished by any suitable means such as an hydraulic press. The next step is to punch or drill an opening 50 in wall 48.

Figure 6:
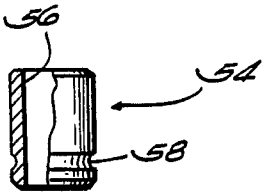
FIG. 6 is a side view (partially in section) of an orifice member.

In the preferred embodiment, orifice assembly 46 is comprised of two parts, namely, a mounting clip 52 and an orifice member 54 Clips 52 (preferably made of spring steel) are of tubular shape and dimensioned for snap engagement in openings 50. Orifice members 54 (FIG. 6) are of cylindrical shape and have a flow passageway 56 therethrough. In the preferred embodiment, orifice members 54 are made of an inorganic material such as ceramic and have an external groove 58 in one end thereof adapted for snap engagement with shoulders 60 formed in the end of mounting clips 52. It will be appreciated from the foregoing description that to install an orifice assembly 46 in tubular member 34, a mounting clip 54 is first snapped into opening 50 and then an orifice member 54 is snapped into clip 54 to complete the installation.

It is noted that the row of orifice assemblies 46 on the top of member 32 are positioned so that the axis of each assembly is directed upwardly and at an angle with respect to the vertical. As indicated in FIG. 3 in the preferred embodiment, such angle is approximately 35°.

Figure 4:
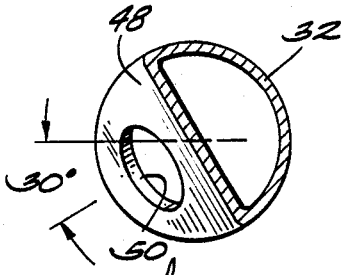
FIG. 4 is a sectional view taken along line 4—4 of FIG. 2 (with orifice assembly removed)
Figure 5:
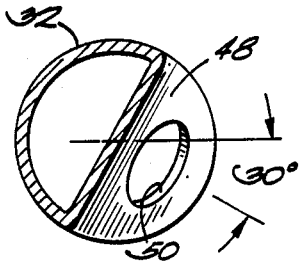
FIG. 5 is a sectional view taken along line 5—5 of FIG. 2 (with orifice assembly removed)

Referring now to FIGS. 2, 4 and 5, it is noted that the orifice assemblies 46 on the inner and outer sides of tubular member 34 extend substantially tangential with respect to the circular axis of tube 34, i.e. at an angle with respect to a radius line extending through orifice openings 50. Orifice assemblies also extend downwardly with respect to a horizontal plane extending through the axis of member 34. As noted in FIGS. 4 and 5 in the preferred embodiment, such downward angle from the horizontal is approximately 30°. In the preferred embodiment, such tangential angle is approximately 35° with respect to a radius line through each orifice opening 50. Finally, it is noted that the orifice assemblies 46 in the inner, outer and top rows all extend in the same direction with respect to the axis of tubular member 34, i.e.,either in a clockwise or counterclockwise direction with respect to the axis of tubular member 32.

Figure 7:
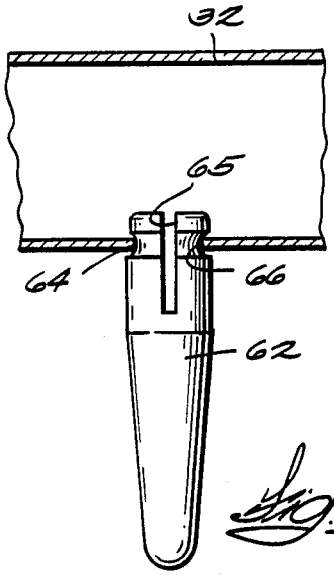
FIG. 7 is a fragmentary side elevation view (partially in section) of a support leg for the agitator assembly.

Referring to FIGS. 1 and 7 in the preferred embodiment, agitator assembly 32 is mounted in the lower portion of the water heater chamber 22 in a spaced relationship with respect to the bottom 14 of the water heater tank. As shown in FIG. 7, the agitator assembly is supported in such spaced relationship with the tank bottom 14 by means of a plurality of leg members 62. In the preferred embodiment, leg members 62 are of plastic material and have a groove 64 and a slot 65 therein dimensioned for snap engagement with openings 66 in the bottom of tubular member 32. The inlet tube 36 and its mounting engagement in tank wall 10 also serves to provide support for the agitator assembly 32 in its desired position in the bottom of the water heater tank In the preferred embodiment, the bottom of agitator assembly 32 is spaced as close to the tank bottom 14 as is practicable. In the embodiment shown and described herein, the distance is approximately 1⅛ inches.

OPERATION

As previously explained, a not uncommon problem in the operation of water heaters of the type involved herein is the tendency (depending primarily on local water conditions) of certain dissolved solid materials in the water precipitating out of the water, which precipitated materials will settle out and accumulate in the bottom portion of the water heater tank. Such scale accumulations, if not periodically removed by some kind of a tank cleaning procedure, will gradually build up and harden causing an adverse effect on the heating efficiency of the unit and in many cases will ultimately cause a premature failure of the heater tank.

The water in chamber 22 will be heated by the hot gases and products of combustion passing through flue tubes 20 from burner 26 or in the case of an electric heater, the water will be heated by an electric heating element.

With the heater of the present invention, each time hot water is withdrawn from chamber 22 through outlet fitting 23 into a water system, cold water will simultaneously be drawn into the agitator assembly 32 from a source of water under pressure.

The cold water drawn into the tank each time hot water is drawn off the top will be expelled into chamber 22 through orifice members 54 in the form of a plurality of jet-like streams. The streams eminating from the outer row of orifices in member 34 will be directed somewhat downwardly at a tangential angle with respect of the flue tubes 20 in the outer row. The streams eminating from the inner row of orifices on member 34 will be directed somewhat downwardly and at a tangential angle with respect to the flue tubes 20 in the inner row 26. The streams eminating from the upper row of orifices on member 34 will be directed upwardly at an angle with respect to the axis of tubular member 34.

The combined action of the jet-like streams eminating from all three rows of orifices will agitate the water in the tank and produce a swirling action in the lower portion thereof In the embodiment shown in FIG. 2, such swirling action will be in a counter-clockwise direction as viewed from above.

More specifically, the jet-like streams eminating from the outer row of orifices will effectively sweep the tank bottom around the base of flue tubes 20 in row 24. Similarly, the jet-like streams eminating from the inner row of orifices will effectively sweep the tank bottom around the base of flue tubes 20 in inner row 26. The jet-like streams eminating from the top row of orifices will enhance the swirling action produced by the jet-like streams eminating from the inner and outer rows of orifices and will further provide an upwardly directed flow component to the overall swirling action.

The swirling action described above will cause solid particles which have settled to the bottom or are in the process of settling to the bottom to be swept upwardly from the bottom into suspension in the water. The normal upward circulation of the water in the tank combined with the upwardly directed streams from the top row of orifices will cause such suspended particles to be carried upwardly in the tank and eventually out through outlet 23. Such stirring and swirling action produced in the tank each time hot water is withdrawn therefrom has proven to be extremely effective in reducing harmful accumulations of scale in the bottom of the tank.

To produce the desired jet-like streams of water at the outlet of orifice members 54, the agitator assembly means 32 is dimensioned so that the aggregate size of flow passageways 56 in orifice members 54 is less than the size of the flow passageway through inlet tube 36. With such relationship, the velocity of the water flowing through the orifices 56 will be greater than the velocity of water flowing through inlet tube 36 from the source of cold water under pressure. For example, in the embodiment shown in FIG. 2, inlet tube 36 is made from 1⅛ inch O.D. stainless steel tubing and passageways 56 in orifice members 54 have a diameter 0.2 inches. With such dimensions, the ratio of the total area of the flow passageways 56 in the orifices 56 (total of 21 orifices) will be approximately 84% of the flow area through inlet tube 36.

I claim:

1. A water heater comprising;

a water tight tank means adapted to contain water under pressure;

a source of heat for heating water inside said tank means;

a hot water outlet means located in the top portion of said tank means through which hot water can be periodically withdrawn from the top portion of said tank means;

an agitator assembly means mounted in the bottom portion of said tank, said agitator assembly means including a circular tubular member connected to a source of water under pressure, said circular tubular member having a first row of orifice means mounted around the inner side thereof and a second row orifice of orifice means mounted around the outer side thereof, said orifice means directed at an angle with respect to a radius line through each of said orifice means, each of said orifice means including a flow passageway through which a jet-like stream of water is directed into said tank means each time water is drawn out of the top portion of said tank means through said hot water outlet means, said orifice means all directed in the same direction with respect to the axis of said circular tubular member to produce a swirling action in the bottom portion of said tank means each time hot water is drawn out of said hot water outlet means, said swirling action effective to cause solid materials which have either settled to the tank bottom or are in the process of settling to the tank bottom to be maintained in suspension in the water so that ultimately at least a portion of such materials will be carried upwardly in said tank means and out said hot water outlet means.

2. A water heater according to claim 1 in which each of said orifice means includes an orifice member having a flow passageway extending therethrough.

3. A water heater according to claim 2 in which each of said orifice means further includes a spring clip member adapted for snap engagement in an opening in said circular tubular member, said spring clip means further adapted to receive and retain one of said orifice members therein.

4. A water heater according to claim 2 in which said orifice members are made of an inorganic material.

5. A water heater according to claim 1 in which said circular tubular member of said agitator assembly is positioned in said tank means in spaced relationship with the bottom of said tank means and said orifice means in said first and second rows are directed downwardly with respect to the horizontal.

6. A water heater according to claim 5 in which the spacing between said circular tubular member and said tank bottom is approximately 1⅝ inches.

7. A water heater according to claim 5 in which the downwardly extending angle of said orifice means in said first and second rows is approximately 30° from horizontal.

8. A water heater according to claim 1 in which said agitator assembly means further includes a third row of orifice means mounted along the top of said circular tubular member, said orifice means in said third row directed upwardly.

9. A water heater according to claim 8 in which said orifice means in said third row are directed upwardly and at an angle with respect to the vertical, said upward angle of said orifice means in said third row being in a direction with respect to the axis of said circular tubular member which is the same as the direction of the orifice means in said first and second rows.

10. A water heater according to claim 9 in which said orifice means in said first, second and third rows all extend in a counter-clockwise direction with respect to the axis of said circular tubular member when viewed from above.

11. A water heater comprising:

a water tight tank means adapted to contain water under pressure;

a plurality of vertical flue tubes mounted in said water tight tank means, said flue tubes arranged in an outer row and an inner row;

a hot water outlet means located in the top portion of said tank means through which hot water can be periodically withdraw from the top portion of said tank means;

an agitator assembly means mounted in the bottom portion of said tank means, said agitator assembly means including a circular tubular member connected to a source of water under pressure, said circular tubular member positioned between said outer and inner row of flue tubes, said circular tubular member having a first row of orifice means mounted around the inner side thereof and directed towards said inner row of flue tubes, said circular tubular member further having a second row of orifice means mounted around the outer side thereof and directed toward said outer row of flue tubes, each of said orifice means including a flow passage way through which a jet-like stream of water is directed into said tank means each time water is drawn out of the top portion of said tank means through said hot water outlet means, said orifice means directed to create a stirring action around the base of said inner and outer rows of flue tubes, said stirring action effective to cause solid materials which have either settled to the tank bottom, or are in the process of settling to the tank bottom, to be maintained in suspension in the water so that ultimately at least a portion of such materials will be carried upwardly in said tank means and out said hot water outlet means.

12. A hot water heater according to claim 11 in which said orifice means in said first and second rows are directed at an angle with respect to a radius line through each of said orifice means, said orifice means all directed in the same direction with respect to the axis of said tubular member to produce a swirling action in the bottom portion of said tank means each time hot water is drawn out of said hot water outlet means.

13. A water heater according to claim 12 in which each of said orifice means includes an orifice member having a flow passageway extending therethrough.

14. A water heater according to claim 13 in which each of said orifice means further includes a spring clip member adapted for snap engagement in an opening in said circular tubular members, said spring clip means further adapted to receive and retain one of said orifice members therein.

15. A water heater according to claim 13 in which said orifice members are made of an inorganic material.

16. A water heater according to claim 12 in which said circular tubular member of said agitator assembly is positioned in said tank means in spaced relationship with the bottom of said tank means and said orifice means in said first and second rows are directed downwardly with respect to the horizontal 17. A water heater according to claim 16 in which the spacing between said circular tubular member and said tank bottom is approximately $1\frac{5}{8}$ inches.

18. A water heater according to claim 16 in which the downward extending angle of said orifice means in said first and second rows is approximately 30° from horizontal.

19. A water heater according to claim 11 in which said agitator assembly means further includes a third row of orifice means mounted along the top surface of said circular tubular member, said orifice means in said third row directed upwardly.

20. A water heater according to claim 19 in which said orifice means in said third row are directed upwardly and at an angle with respect to the vertical.

21. A water heater according to claim 20 in which the orifice means of said first, second and third rows are all directed at an angle with respect to the axis of said circular tubular member, said direction in which all of said orifice means extends being the same with respect to the axis of said circular tubular member.

22. A water heater according to claim 21 in which said orifice means in said first, second and third rows all are directed in a counter-clockwise direction with respect to the axis of said circular tubular member when viewed from above.

23. The method of heating and circulating water in a water tight tank adapted to contain water under pressure comprising the steps of:

(1) periodically withdrawing water from the top portion of the tank;

(2) introducing water into the bottom portion of the tank from a source of water under pressure each time water is withdrawn from the top of the tank;

(3) imparting a swirling action to the water in the bottom portion of the tank each time water is withdrawn and introduced according to steps (1) and (2), such swirling action created by causing the water entering the tank to flow into the tank in the form of multiple jet-like streams passing through a plurality of orifice means spaced along the inner and outer sides of a circular tubular member, said circular tubular member positioned in the lower portion of said tank and connected to a source of water under pressure, said orifice means directed at an angle with respect to a radius line through each of said orifice means, each of said orifice means including a flow passageway through which said jet-like streams of water are directed into the tank each time water is drawn out of the top portion thereof, said orifice means all directed in the same direction with respect to the axis of said circular tubular member to produce the desired swirling action in the bottom portion of the tank, said swirling action effective to cause solid materials which have either settled to the bottom or are in the process of settling to the bottom to be maintained in suspension in the water so that ultimately at least a portion of such materials will be carried upwardly in the tank and out the top portion of the tank.

24. The method according to claim 23 in which said swirling action and upward circulation is enhanced by means of a third row of orifice means mounted along the top of said circular tubular member, said orifice means in said third row being directed upwardly and at an angle with respect to the vertical, said upward angle of said orifice means in said third row being in a direction with respect to the axis of said circular tubular member which is the same as the direction of the orifice means in said first and second rows.

25. The method according to claim 23 in which said circular tubular member of said agitator assembly is positioned in said tank in spaced relationship with the bottom of said tank and said orifice means in said first and second rows are downwardly with respect to the horizontal.

* * * * *